United States Patent [19]

Crider

[11] Patent Number: 4,683,687

[45] Date of Patent: Aug. 4, 1987

[54] VIEW EXPANSION ENCLOSURE WITH VENTING MEANS

[76] Inventor: Brian D. Crider, 426 Oak View Terr., Palm Harbor, Fla. 33563

[21] Appl. No.: 929,102

[22] Filed: Nov. 10, 1986

Related U.S. Application Data

[63] Continuation-in-part of Ser. No. 828,031, Feb. 10, 1986, abandoned.

[51] Int. Cl.[4] ..... E04B 7/16

[52] U.S. Cl. ..... 52/72; 52/199; 49/324; 98/42.14

[58] Field of Search ..... 52/72, 199, 64, 66, 52/1, 82, 19, 245, 200, 300, 302, 126.7; 98/42.14, 61; 49/354, 40, 324, 355

[56] References Cited

U.S. PATENT DOCUMENTS

| | | | |
|---|---|---|---|
| 230,952 | 8/1880 | Mark | 98/42.14 X |
| 2,775,794 | 1/1957 | Keely | 52/199 X |
| 3,358,576 | 12/1967 | Kelly et al. | 49/354 X |
| 4,068,408 | 1/1978 | Hauber | 49/354 X |

FOREIGN PATENT DOCUMENTS

| | | | |
|---|---|---|---|
| 606497 | 7/1960 | Italy | 52/72 |
| 174998 | 4/1961 | Sweden | 52/72 |
| 1366381 | 9/1974 | United Kingdom | 114/71 |
| 2060729 | 5/1981 | United Kingdom | 52/72 |

*Primary Examiner*—J. Karl Bell

*Attorney, Agent, or Firm*—Ronald E. Smith

[57] ABSTRACT

A structure that provides a substantially unrestricted view of the surrounding environment to its occupants. The structure includes a lower portion defined by upstanding transparent walls, and an upper transparent portion having the general appearance of an inverted funnel. The inverted funnel shape of the structure directs rising hot air currents to the inlet of a chimney positioned at the apex of the inverted funnel. The vertical position of a closure member which forms a part of the chimney is adjustable by the occupants of the structure to control air flow within the structure.

19 Claims, 11 Drawing Figures

FIG_4
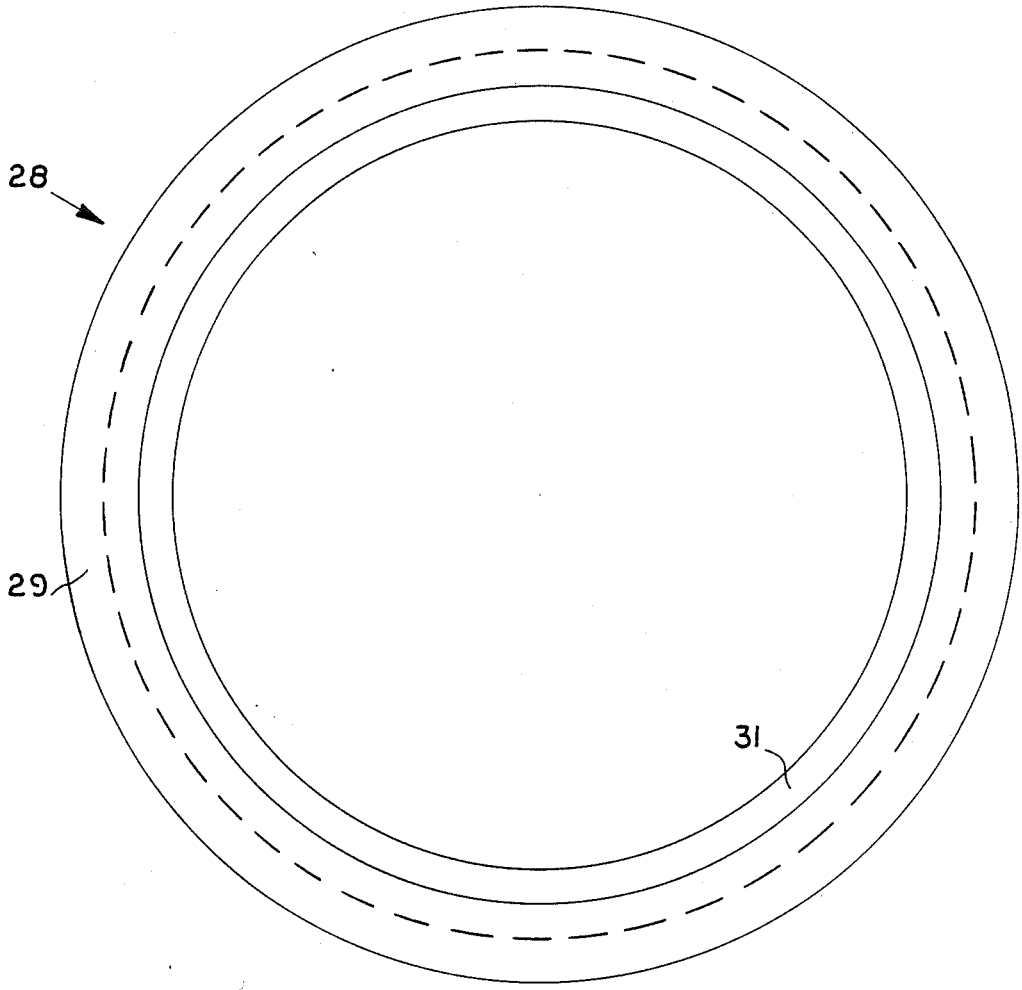
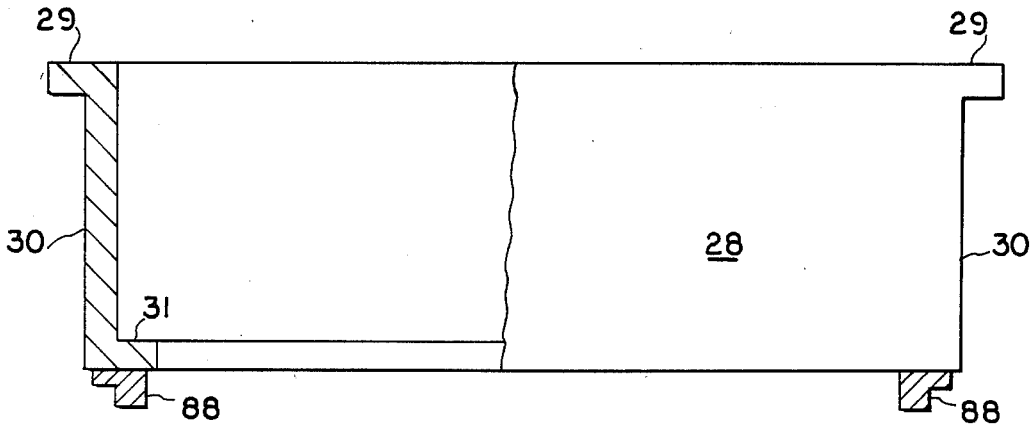
FIG_4A

VIEW EXPANSION ENCLOSURE WITH VENTING MEANS

CROSS-REFERENCE TO RELATED APPLICATIONS

This is a continuation-in-part of copending application bearing Ser. No. 06/828,031, filed 02/10/86 by the present inventor now abandoned.

BACKGROUND OF THE INVENTION

1. Field of the Invention

This invention relates, generally, to view expansion enclosures, and more particularly relates to a view expansion enclosure with a venting means in the form of a chimney that can be opened and closed as desired to control the flow of air therethrough.

2. Description of the Prior Art

Enclosure structures having transparent sidewalls or roofs in general are known to the construction art. Although they can be ued for structure expansion purposes, they are commonly used as greenhouses. They can be attached to a permanent stucture, such as a house, or they can stand alone.

Examples of building structures with glass walls are shown in U.S. Pat. No. 2,706,538 to Schumann (1955) and U.S. Pat. No. 2,775,794 to Keely (1957).

A 1960 Italian patent to Svenska, No. 606,497, shows a skylight cover in the form of a dome which dome resembles the closure means for the chimney assembly of the present invention.

U.S. Pat. No. 3,562,972 to D'Amato (1971), discloses a greenhouse construction which is attachable to a supporting structure. It is portable and readily assembled.

A convertible, foldable and portable greenhouse is shown in U.S. Pat. No. 3,869,827 to Anderson and others (1975).

A 1976 patent to Smrt, No. 3,987,597, shows a modular structural assembly of the knock down type.

U.S. Pat. No. 4,335,547 to Maxwell (1982), discloses a movable greenhouse construction adapted for use on a balcony or a patio having means for moving the greenhouse laterally with respect to the building to which it is attached.

The prior art structures do not suggest how air flows through the structures could be controlled by means other than the opening of windows or doors.

It is therefore a central object of this invention to provide a view expansion enclosure having window and door-independent means for controlling the flow of air therethrough.

A closely related object is to provide the foregoing means in an embodiment operable by an occupant of the structure from within the structure.

SUMMARY OF THE INVENTION

The invention accomplishes these and other objects by providing a view expansion enclosure that includes a roof having the contour of an inverted funnel.

A mechanical vent valve hereinafter referred to as a chimney is positioned at the apex of the inverted funnel. By adjusting the vertical position of a cap member that overlies and closes the chimney when in its fully closed or down position, the flow of hot air currents flowing from the bottom to the top of the structure are controlled.

The chimney includes a sleeve member having an upper rim upon which the cap member seats when the chimney is closed. Rotation of a gear housing effects axial travel of a vertically aligned worm gear means and hence effects raising and lowering of the cap means dependent upon which direction the gear is advanced.

The cap member has concave bottom walls; when the cap is raised from its seat, a venturi effect is established due to the concave configuration of the cap bottom and the size of the annular space created by separation of the cap from the sleeve.

The novel structure provides several significant features and advantages.

The mechanically openable and closeable chimney, for example, provides a simple yet elegant and accurate means for controlling air currents within the structure.

Moreover, the versatility of the structure renders it suitable for various uses, such as a greenhouse use or use as a leisure area with a substantially unrestricted view of the surrounding environment.

The novel structure can be attached to an existing structure, or it can be built as a free standing structure.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 4 is a top plan view of the mating ring assembly

FIG. 4A is a front elevational view of the assembly shown in FIG. 4;

Similar reference numerals refer to similar parts throughout the several views of the drawings.

DETAILED DESCRIPTION OF THE PREFERRED EMBODIMENT

Figure 1:
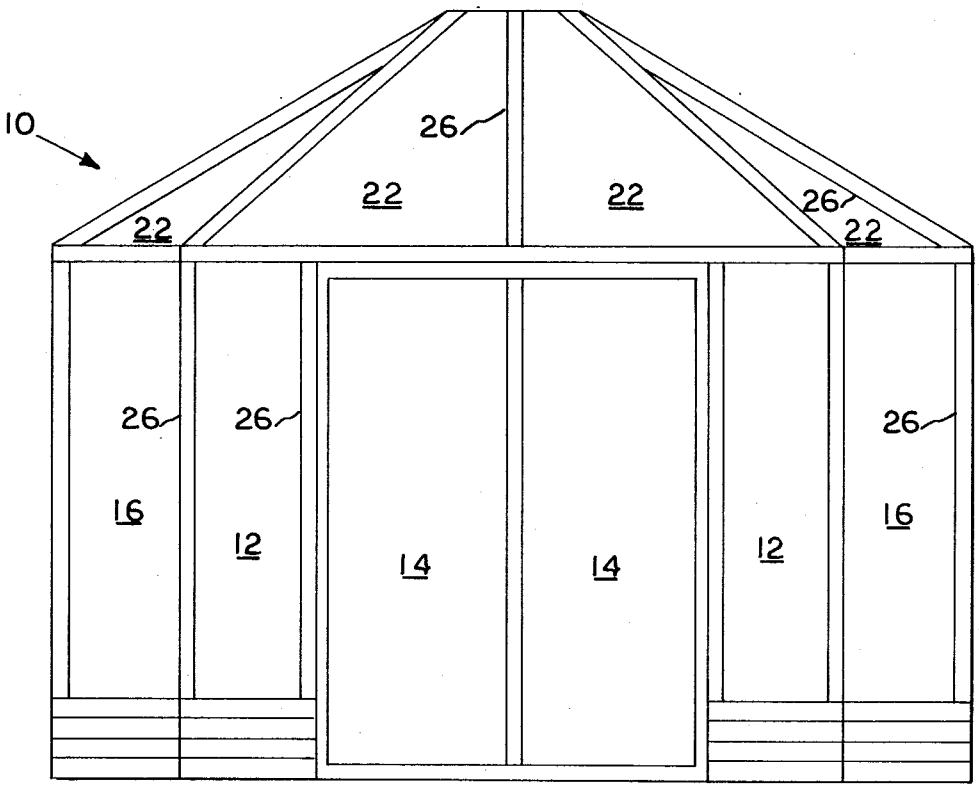
FIG. 1 is a front elevational view of a structure made in accordance with the teachings of this invention.

Referring now to FIG. 1, it will there be seen that an embodiment illustrative of the inventive teachings of the present disclosure is designated by the reference numeral 10 as a whole.

Figure 2:
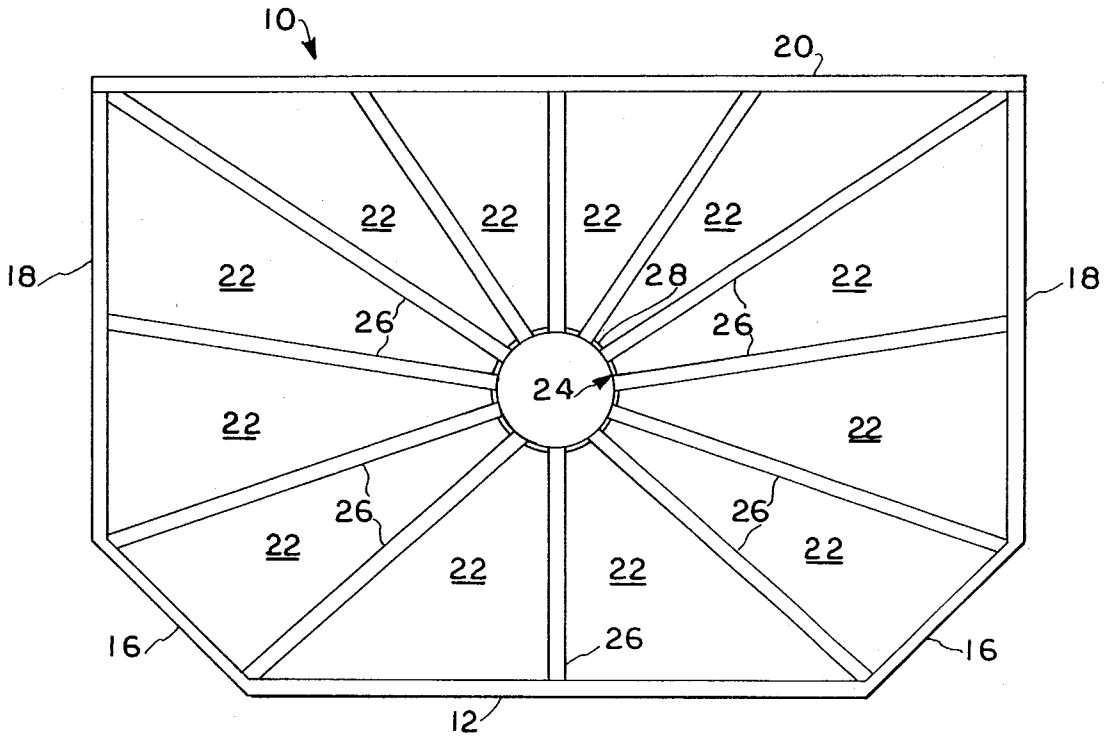
FIG. 2 is a top plan view of the structure of FIG. 1.

Although the structure may take many forms, such as triangular, square, pentagonal, and so on, in this particular embodiment which is provided for illustrative purposes as aforesaid, the shape is as shown in FIG. 2, i.e., this particular structure has a front wall 12 within which is provided sliding doors 14 (shown in FIG. 1), corner walls 16, 16, side walls 18, 18 and a rear wall denoted 20.

This embodiment has a roof of twelve panels, collectively designated 22. FIG. 1 best depicts the inverted funnel shape of the roof, but FIG. 2 best depicts how the panels converge to a circular chimney means 24. The structure includes no fireplace, and the term "chimney" is used herein to indicate a tubular, air-carrying conduit or sleeve that vents heat from an enclosed space into the atmosphere.

The walls of structure 10 are preferably transparent so that persons within the enclosure may have a substantially unrestricted view of the surrounding environment. Accordingly, glass or a suitable substitute is the preferred material for the walls and roof of the structure 10. Frame members 26 are preferably metallic but those skilled in the art of materials will know other suitable materials that could be used. Moreover, those skilled in the construction arts will know how to build the structure 10 and many variations thereof in view of this disclosure, so no description is contained herein concerning how to mate the glass walls to the metallic frames and so forth since such details of construction are not within the scope of this invention, per se.

However, FIGS. 1 and 2 do depict a very important teaching of this invention, the provision of a roof having the general configuration of an inverted funnel. All of the roof panels 22 direct hot air upwardly toward the chimney means 24, and this is an important feature of the invention.

Figure 3:
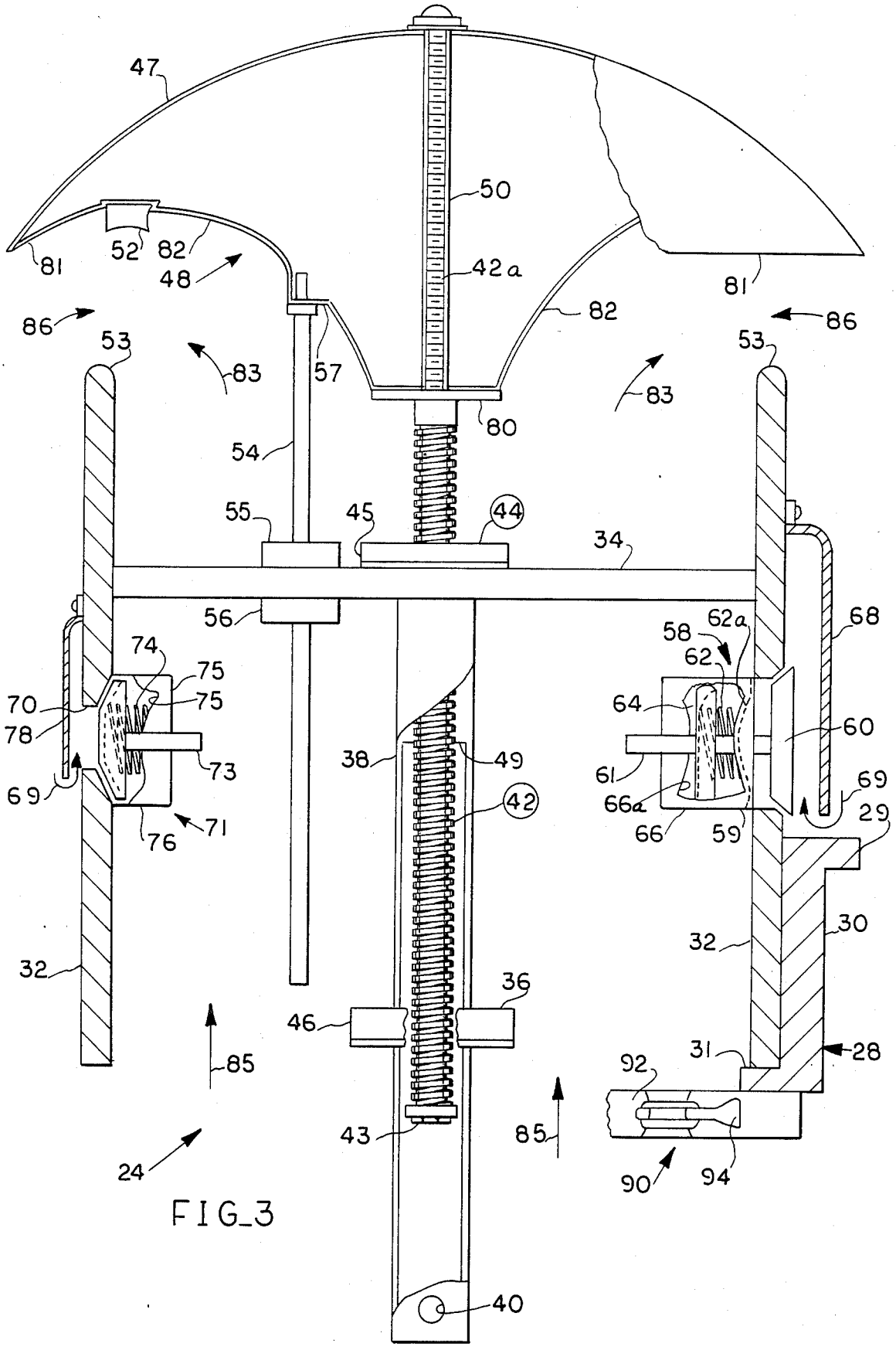
FIG. 3 is primarily a longitudinal sectional view of the novel chimney assembly, but showing some parts such as a portion of the outer surface of the novel cap member, a portion of the gear housing, and a portion of the screen holder in front elevation.

When structure 10 is built, a circular opening is formed in the roof as suggested by FIG. 2, i.e., the roof panels 22 converge toward one another as depicted but do not meet at the apex of the structure; each roof panel 22 terminates at a ring member 28 the top annular flange of which is shown in FIG. 2 but the structure of which is best understood in connection with FIG. 3 to which FIG. attention should now be directed.

Ring 28 is termed herein the mating ring 28 because it is the foundation to which the roof panels 22 are attached and it is also the foundation which carries the balance of the parts of chimney 24.

It should therefore be understood that the annular surface 30 of mating ring 28 is the surface to which the innermost or uppoermost ends of roof panels 22 are fixedly secured.

Mating ring 28 has an outwardly turned annular flange 29 and an inwardly turned annular flange 31 as is clearly shown in FIG. 3.

The inwardly turned flange 31 slidingly receives and supports cylindrical sleeve member 32.

A first cross bar 34 diametrically extends across sleeve member 32, and a second cross bar 36, positioned orthogonally with respect to first cross bar 34 and spaced downwardly therefrom as shown, also extends diametrically across sleeve member 32.

Both cross bar members 34, 36 are centrally apertured. A rotatably mounted, cylindrical gear housing 38 extends through the central apertures as indicated in FIG. 3.

It will be observed in FIG. 3 that the lowermost end of housing 38 is provided with a bore means 40; this bore means is releasably engaged by a suitable torque rod as shown in the cross-referenced disclosure. Rotation of the torque rod, not shown in the present disclosure, by an occupant of structure 10 while standing therewithin, effects rotation of housing 38 about its vertical axis of symmetry.

Housing 38 houses an elongate worm gear member 42 which has a nut and washer 43 secured to its lowermost end.

Collar member 44 is fixedly secured to or integrally formed with housing 38 at its uppermost end and therefore rotates conjointly therewith.

Collar member 44 is internally threaded and screw-threadly receives worm gear 42; accordingly, rotation of housing 38 and hence collar 44 effects axial travel of worm gear 42.

Friction-reducing bushing members 45, 46, associated with cross bars 34, 36, respectively, are employed for the purpose their name expresses.

Axial travel of gear 42 effects raising or lowering of cap member 48, dependent upon the direction housing 38 is rotated by the person turning the torque rod.

Thus, the cap member 48 does not rotate significantly as it travels up or down.

As is apparent, cap 48 has a generally hemispherical appearance.

An uppermost limit to the travel of cap 48 is set by the nut and washer 43 at the lowermost end of worm gear 42, i.e., washer 43 enters into abutting relation to annular shoulder 49 and prevents further raising of cap 48.

Cap 48 is hollow so that it will be light in weight and thus easy to raise and lower. However, if an occupant were to overly tighten the cap when in its closed position, theoretically cap 48 could be deformed due to its hollow construction. Thus, a sleeve 50 of rigid construction slideably receives the extension 42*a* of worm gear 42 and resists compressive forces.

An annular seal 52 is fixedly secured to the bottom of cap 48 as shown; seal 52 seats against the upper peripheral rim 53 of sleeve member 32 when cap 48 is closed.

Thus, when cap 48 is in its "down" position, no significant circulation of air can occur within structure 10 if doors 14 are closed.

It has been found that annular seal 52 and rim 53 form an excellent seal especially if cap member 48 is maintained against even minimal amounts of rotation. As mentioned earlier, cap 48 does not rotate significantly since worm gear 42 travels axially to lift or lower said cap 48; however, small amounts of rotation can occur.

The small rotation of cap 48 thus effected could be ignored and the inventive chimney means would still perform its intended function, but careful study has determined that a different sealing relationship is established for each lowering of cap 48 because different sections of annular seal 52 seat against annular rim 53 when small amounts of rotation are tolerated.

An anti-torque rod 54 is thus provided and is shown in FIG. 3. Its upper end is screw-theadedly engaged or otherwise fixedly secured to cap 48 at flat surface 57; rod is vertically deployed and extends through an aperture formed in upper cross bar 34, and boss members 55, 56 help maintain its vertical alignment. It is slideably received within said bosses 55, 56.

In this manner, everytime cap 48 is lowered, anti-torque rod 54 assures that seal 52 will seat on rim 53 at precisely the same location, thereby effecting a hermetic seal.

Since structure 10 may be closed so tightly, it is advisable to provide it with relief ports for both positive and negative pressures, especially in view of the glass construction of the enclosure.

A pressure relief valve means is generally denoted 58 in FIG. 3; it is positioned in registration with an aperture 59 formed in sleeve member 32. Importantly, the aperture has an annular bevel formed therein, contiguous to the outer surface of sleeve 32, as shown in FIG. 3.

A valve member 60 is complementally beveled as shown so that when it is seated on the beveled rim of aperture 59, no air can enter or exit structure 10 through said aperture.

Valve member 60 is carried by valve stem 61 which is elongate as shown; a spring member 62 has a base which abuts a baffle member 64, said baffle member being centrally apertured, carried by valve stem 61 and fixedly secured thereto.

The other end of spring 62 abuts spring support surface 62*a*. A housing 66 having opening 66*a* formed therein slideably mounts baffle member 64; opening 66*a* of housing 66 allows the atmospheric pressure inside structure 10 to bear against baffle member 64. The strength of spring 62 is selected so that when the pressure inside structure 10 is substantially equal to the pressure of the surrounding atmosphere, valve member 60 will be seated against the beveled annular rim of aperture 59.

Thus, when the pressure inside structure 10 exceeds a predetermined threshold, spring 62 compresses under the action of baffle member 64 and valve 60 is unseated so that air can leave structure 10 through aperture 59.

A shroud member 68 is shown protecting pressure relief valve 58 from the elements. The outwardly directed flange 29 of mating ring 28 constrains rain or other elements to execute a return bend as denoted by the arrow 69 to enter the confines of shroud 68. Thus, the elements are effectively prevented from befouling the valve 58 by the cooperation of shroud 68 and flange 29.

A vacuum relief valve of similar construction is also formed in sleeve member 32 and is denoted 71 as a whole. An aperture 70 having an inwardly beveled annular rim provides a seat for valve member 72 carried by elongate stem 73, said bevel being on the inside of sleeve 32 as shown instead of on the outside as was the case with pressure relief valve 58. Spring 74 has a preselected threshold which is overcome by atmospheric pressure outside enclosure 10 when the pressure inside said enclosure falls below a preselected pressure. Housing 75 has opening 75*a* formed therein to communicate pressure within structure 10 to the inside of said housing.

Both valves have an elongate stem as aforesaid, said stems having ends that extend beyond their respective housings 66, 76. Occupants of the structure 10 can thus operate the valves, by pulling on vacuum valve stem 73 or by pushing on pressure valve stem 61. Thus, if the occupants desire a pressure change that is not within the preselected limits of the springs, manual operation of the valves effects the desired results. The stems could also be pushed or pulled if the springs were to malfunction for any reason. Moreover, maintenance of the valves may require opening and closing of the valves from time to time.

The shroud 78 that protects vacuum valve 71 has the same construction of the pressure relief shroud 68 and also cooperates with the outwardly turned annular flange 29 of mating ring 28 to constrain rain and the like to follow the path indicated by arrow 69.

The shape of the bottom of cap 48 is important; as indicted in FIG. 3, the bottom of cap 48 includes flat central portion 80 and concave sidewalls 82.

The concave walls 82 cause air impinging thereagainst to flow in the direction indicated by the directional arrows 83.

It will be observed that a venturi effect arises from the moment cap 48 is raised from its seat on the annular rim 53 of sleeve member 32, because of the concave shape of the bottom of cap 48.

The volume of air entering sleeve member 32 as indicated by the arrows 85, appearing at the lower end of FIG. 3, will be constrained to exit sleeve member 32 between the gap existing between rim 53 of sleeve member 32 and the bottom of cap 48. When cap 48 is only partially raised as in FIG. 3, a low pressure area in the vicinity of the space denoted by the reference numeral 86 will arise, and the presence of such low pressure area will accelerate the flow of air out of the enclosure.

The hemispherical in configuration top surface 47 of cap 48 overhangs its concave bottom wall 82 to form an annular overhang denoted 81 in FIG. 3; the overhang prevents rain from dripping into sleeve 32.

It is desireable to provide a screen at the lower end of sleeve 32 in order to prevent debris from entering the sleeve which debris could clog the valves or otherwise mar performance of the inventive chimney.

Figure 5:
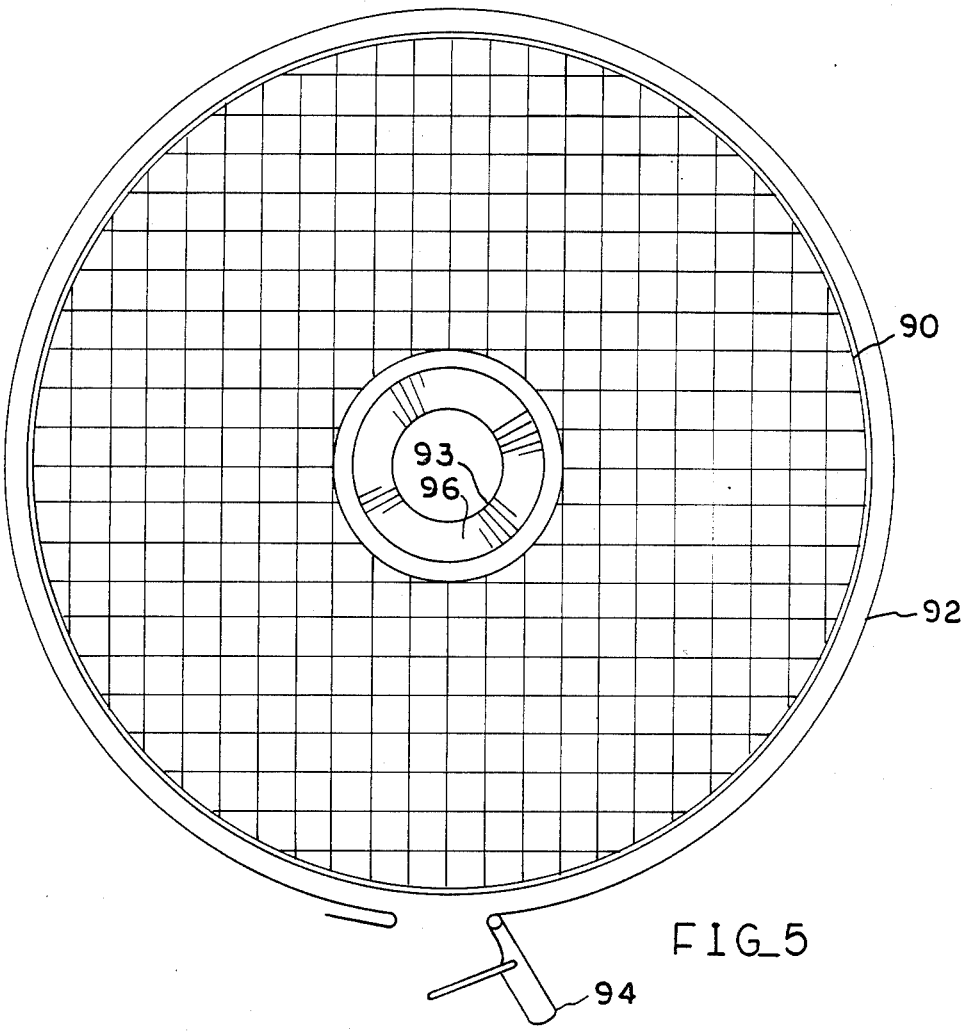
FIG. 5 is a top plan view of a screen used in the assembly of FIG. 3.

FIG. 4A shows that an annular shoulder member 88 is fixedly secured to or integrally formed with mating ring 28 at its bottom; the screen member 90 shown in FIG. 5 is mounted to said annular shoulder member 88 as is best understood in connection with FIG. 3.

Screen 90 (FIG. 5) is surrounded by tightening band 92 having a latch means 94, which latch means is shown closed in FIG. 3. The securing of latch 94 tightens and thus screen 90 to its annular mount 88 and thus ensures that it will not be dislodged.

The latch allows the screen to be easily removed whenever required for maintenance reasons.

Figure 5A:
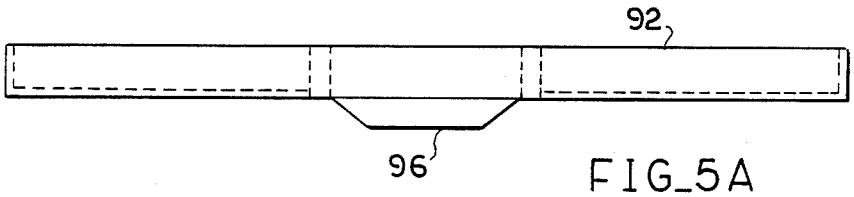
FIG. 5A is a front elevational view of the screen shown in FIG. 5.
Figure 5B:
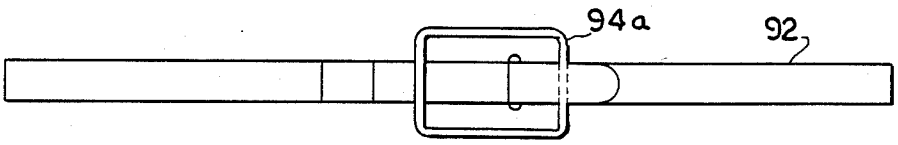
FIG. 5B is a front elevational view of an alternative embodiment of the latch for the screen holder.
Figure 6B:
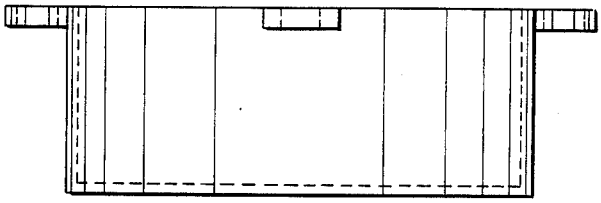
FIG. 6B is a top plan view of the shroud shown in FIG. 6.
Figure 6:
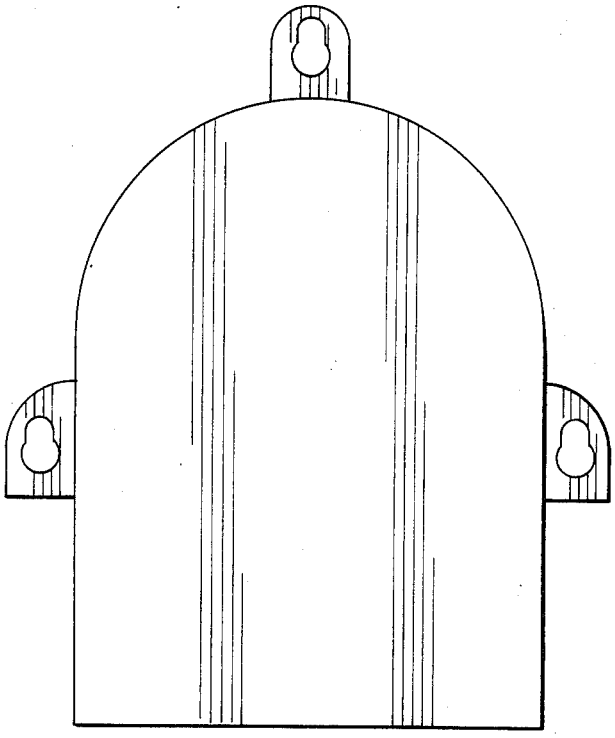
FIG. 6 is a front elevational view of a shroud member of the type that covers the pressure relief and vacuum relief valves shown in FIG. 3.
Figure 6A:
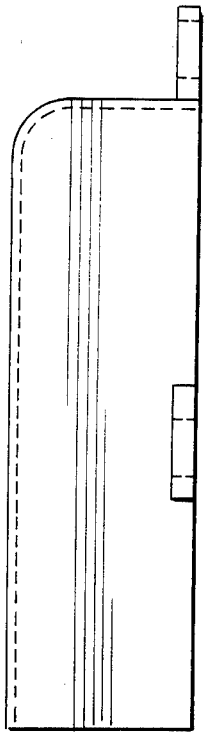
FIG. 6A is a side elevational view of the shroud shown in FIG. 6.

Screen 90 is centrally apertured as at 93 to receive gear housing 38; since gear housing 38 rotates when cap 48 is being raised or lowered, a means must be provided to seal aperture 93 around said housing 38. The chosen means is a pliable seal denoted 96 in FIGS. 5 and 5A.

The invention is thus understood to have numerous inventive features; it represents a significant advance in the art of structures in general, as well as in the art of ventilating means for enclosed structures.

The construction of the preferred embodiment is reliable. Moreover, the chimney means is economical to manufacture and thus its provision does not add appreciably to the cost of the glass enclosure 10.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, I claim:

1. A structure of the type which enables its occupants to have a substantially unrestricted view of the environment surrounding the structure and which allows its occupants to control the flow of air currents therethrough, comprising:

a multifaceted lower portion defined by a plurality of flat, upstanding, transparent rectangular sidewalls;

a multifaceted upper portion having flat, transparent, inclined topwalls, said inclined topwalls collectively having the appearance of an inverted funnel and being positioned so as to converge toward an apex of the structure;

a circular opening formed in said structure at its apex, each of said converging topwalls having an arcuate cut out portion formed in its uppermost end so that said circular opening is collectively defined by said cut out portions;

an upstanding tubular sleeve member positioned in registration with said opening so that air within said structure can exit therefrom through said sleeve member;

an adjustably mounted, hemispherical in configuration cap member associated with said sleeve member;

an occupant-operated opening and closing means for raising and lowering said cap member with respect to said sleeve member so that air currents cannot flow out of said structure through said sleeve member when said cap member is in its lowered position;

and said cap member having a bottom with a centrally disposed, flat, circular base means and wherein concave sidewalls are mounted about the periphery of said base means and extend unpwardly and outwardly therefrom to promote air flow through said sleeve member with a minimum amount of turbulence.

2. The structure of claim 1, wherein the hemispherical in configuration cap member has a hemispherical in configuration top wall the outer periphery of which overhangs said sleeve member to prevent moisture dripping from annular edges of said cap member from falling into said sleeve member.

3. The structure of claim 2, wherein an upwardmost and outwardmost annular edge of said concave sidewalls of said cap member bottom merges with an under surface of the hemispherical top wall of said cap member along an annular line that is spaced radially inwardly relative to the annular periphery of said cap member top wall.

4. The structure of claim 1, further comprising a cap member sealing means for providing a substantially air tight seal when said cap member is closed.

5. The structure of claim 4, further comprising a cap member anti-rotation means for preventing rotation of said cap member about a vertical axis when it is being raised or lowered.

6. The structure of claim 5, wherein said sealing means comprises an annular seal member affixed to the bottom of said cap member, said seal member being positioned in registration with an upper annular rim of said sleeve member.

7. The structure of claim 6, wherein said occupant-operated means for raising and lowering said cap member comprises:

an elongate, upstanding, rotatably mounted hollow gear housing member;

an elongate, rotatably mounted gear member received within said gear housing member;

said cap member centrally disposed flat base being fixedly secured to an uppermost free end of said gear member so that said cap member moves upwardly and downwardly responsive to like motion of said gear member;

a gear member engaging means;

said gear member engaging means being conjointly rotatable with said gear housing member and being operative to effect axial travel of said gear means attendant rotation of said gear housing member and hence said gear member engaging means;

and occupant-operated crank means for effecting rotation of said gear housing member whereby conjoint rotation of said gear member engaging means effects vertical but non-rotating displacement of said cap member.

8. The structure of claim 7, wherein said occupant-operated means further comprises:

a centrally apertured upper cross bar member that extends diametrically across said sleeve member;

a centrally apertured lower cross bar member that extends diametrically across said sleeve member;

said lower cross bar member being spaced downwardly relative to said upper cross bar member and being disposed orthogonally with respect to said upper cross bar member;

said gear member engaging means being a threaded collar member fixedly secured to said upper cross bar member and being positioned in registration with the central aperture formed therein;

said gear housing member extending through the central apertures formed in said upper and lower cross bars members and the gear member within said housing being disposed in screw-threaded engagement with said collar member so that rotation of said gear housing member about its vertical axis of symmetry imparts axial travel to said gear member in a direction dependant upon the direction of rotation of said gear housing member.

9. The structure of claim 8, wherein said cap member anti-rotation means comprises an upstanding anti-torque rod member having an uppermost end fixedly secured to said cap member bottom, said anti-torque rod member extending through an aperture formed in said upper cross bar member which aperture is laterally spaced relative to the central aperture formed in said upper cross bar member.

10. The structure of claim 9, further comprising a positive pressure relief means that opens to allow escape of air from the structure when the cap member is closed and when the barometric pressure or air within the structure exceeds a predetermined threshold, said positive pressure relief means provided in the form of an outwardly opening pressure relief valve means positioned in registration with an aperture formed in said sleeve member.

11. The structure of claim 10, further comprising a negative pressure relief means to allow entry into said structure of air outside said structure when the barometric pressure within the structure falls below a predetermined threshold, said negative pressure relief means provided in the form of an inwardly opening valve means positioned in registration with an aperture formed in said sleeve member.

12. The structure of claim 11, wherein said cap member is hollow, and wherein cap stiffening means are included to prevent said cap member from deforming if over tightened, said cap stiffening means provided in the form of a rigid tubular sleeve member which houses a portion of said gear member that extends through said cap member.

13. The structure of claim 12, further comprising a mating ring member positioned within said circular opening at the apex of said structure, said mating ring member having an outwardly turned annular flange formed at its upper periphery and having an inwardly turned annular flange formed at its lower periphery, said mating ring member slideably receiving said sleeve member and said sleeve member supported by said inwardly turned annular flange.

14. The structure of claim 13, further comprising a screen member releasably secured to said sleeve member at its lowermost end, said mating ring member having a screen mounting means depending thereform.

15. The structure of claim 14, wherein said screen mounting means comprises an annular shoulder member fixedly secured to the bottom of said mating ring member.

16. The structure of claim 15, wherein said screen member is centrally apertured to rotatably receive said gear housing member, and wherein a pliable seal member mounted to the periphery of said screen member central aperture sealingly engages said gear housing member.

17. The structure of claim 16, further comprising first and second shroud members which are positioned in spaced apart but shielding relation to associated positive and negative pressure relief valve means.

18. The structure of claim 17, wherein the outwardly turned annular flange of said mating ring member cooperates with said first and second shroud members to constrain elements attempting to circumvent the respective shields presented by said shroud members to follow a path of travel that includes a return bend.

19. A structure having a roof with an inverted funnel configuration comprising a sleeve member mounted at an apex of said roof, a movably mounted cap member mounted in capping relation to an upper end of said sleeve member, an occupant-operated means for raising and lowering said cap member, and said cap member being substantially hemispherical in configuration and having concave bottom walls to provide a venturi effect associated with an upward airflow through said sleeve member when said cap member is raised with respect to said sleeve member, said cap member bottom walls further including a flat, circular base means having concave sidewalls mounted about the periphery thereof and projecting upwardly and outwardly therefrom.

* * * * *